US011506046B2

(12) United States Patent
Loh et al.

(10) Patent No.: US 11,506,046 B2
(45) Date of Patent: Nov. 22, 2022

(54) INSTRUMENTED COUPLING ELECTRONICS

(71) Applicants: Yuh Loh, Cypress, TX (US); Thomas McClain Scott, Cypress, TX (US); James Joseph Freeman, Houston, TX (US); John Raggio, Spring, TX (US); Lorn Rendall, Houston, TX (US)

(72) Inventors: Yuh Loh, Cypress, TX (US); Thomas McClain Scott, Cypress, TX (US); James Joseph Freeman, Houston, TX (US); John Raggio, Spring, TX (US); Lorn Rendall, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 26 days.

(21) Appl. No.: 17/124,400

(22) Filed: Dec. 16, 2020

(65) Prior Publication Data

US 2022/0186602 A1 Jun. 16, 2022

(51) Int. Cl.
*E21B 47/01* (2012.01)
*E21B 17/02* (2006.01)

(52) U.S. Cl.
CPC ..... *E21B 47/01* (2013.01); *E21B 17/028* (2013.01)

(58) Field of Classification Search
CPC ..... E21B 47/01; E21B 17/028; E21B 17/023; E21B 17/003
See application file for complete search history.

(56) References Cited

U.S. PATENT DOCUMENTS

| | | | | |
|---|---|---|---|---|
| 4,570,481 | A * | 2/1986 | McLaurin | E21B 47/01 73/152.52 |
| 5,126,564 | A | 6/1992 | Perry et al. | |
| 5,303,773 | A * | 4/1994 | Czernichow | E21B 47/017 166/242.6 |
| 6,499,541 | B1 * | 12/2002 | Hiron | E21B 47/017 166/162 |
| 10,280,735 | B2 | 5/2019 | Finke et al. | |
| 2013/0105222 | A1 | 5/2013 | Pate | |
| 2014/0041863 | A1 * | 2/2014 | Dowling | E21B 47/01 166/250.01 |

(Continued)

OTHER PUBLICATIONS

International Search Report and Written Opinion dated Apr. 14, 2022 in Application No. PCT/US2021/063658, 11 Pages.

*Primary Examiner* — Brad Harcourt
(74) *Attorney, Agent, or Firm* — Sprinkle IP Law Group

(57) ABSTRACT

An compact instrumented downhole coupling that includes a carrier and a set of sensors and electronics that are installed within the carrier. The carrier is a tubular structure having couplings at each end and a bore extending through the carrier from the first end to the second end, forming a carrier wall between the bore and the exterior surface of the carrier. The bore and couplings are offset from a central axis of the carrier (the axis of the cylindrical outer surface of the carrier), resulting in a thicker portion of the carrier wall on one side of the carrier. Cavities are formed (e.g., by drilling holes) within the thicker portion of the carrier wall. One or more sensors and corresponding electronics are then positioned within the cavities, so that the carrier wall itself forms a housing for the sensors and electronics.

18 Claims, 8 Drawing Sheets

(56) References Cited

U.S. PATENT DOCUMENTS

| | | | | |
|---|---|---|---|---|
| 2014/0231066 | A1* | 8/2014 | McColpin | E21B 47/06 166/66 |
| 2015/0226053 | A1 | 8/2015 | Mueller et al. | |
| 2017/0268326 | A1 | 9/2017 | Schlumberger | |
| 2019/0100976 | A1* | 4/2019 | Carmody | E21B 17/023 |

* cited by examiner

INSTRUMENTED COUPLING ELECTRONICS

BACKGROUND

Field of the Invention

The invention relates generally to electronic equipment, and more particularly to instrumented couplings that are configured to be installed downhole in wells.

Related Art

It is often desirable to use electronic sensors to make measurements of conditions within a well. These sensors may be installed on in-line carriers that are connected to production tubing or other pieces of downhole equipment that are positioned within the well. Conventionally, the carriers are constructed by forming a mandrel that has couplings on each end and a bore therethrough so that it can be connected in line with the tubing and/or equipment. A pocket is milled into the exterior surface of the mandrel to accommodate an elongated sensor package. The sensor package is then mounted within this pocket. If it is desired to provide multiple sensors, the pocket on the exterior of the mandrel is made large enough to accommodate each of the sensor packages (which are typically mounted side-by-side within the pocket).

There are a number of disadvantages to the conventional construction of these gauge packages. For example, a typical gauge package may be several feet long, and may therefore require a substantial amount of material to form the mandrel, which incurs substantial cost. Additionally, each of the individual sensor packages that is installed on the exterior of the mandrel normally requires its own tubular housing which provides a sealed enclosure that contains the sensor and electronic components. This housing may also provide some protection for these components, as the sensor package is installed in a somewhat exposed location on the exterior of the mandrel and may therefore be subject to damage as the gauge package is installed or used in the well. Another disadvantage is that, if the sensor is intended to measure conditions within the bore of the mandrel, a port must be drilled from the exterior pocket to the bore at the interior of the mandrel, and a manifold at the end of the housing of the sensor package must be mounted over this port and sealed.

It would therefore be desirable to provide an improved gauge package that reduces or eliminates one or more of the disadvantages of conventional designs.

SUMMARY OF THE INVENTION

This disclosure is directed to systems and methods for providing instrumented couplings that carry corresponding downhole sensors. The improved instrumented coupling uses a carrier which serves not only as a coupling, but also as a housing for sensors and associated electronics that are installed in pockets or cavities within the carrier wall. The carrier may have an offset bore, so that the carrier wall is thicker on one side, allowing larger cavities to be provided for the sensors and electronics.

One embodiment comprises an instrumented downhole coupling that includes a carrier and a set of sensors and electronics that are installed within the carrier. The carrier is a tubular structure having a first coupling at a first end and a second coupling at the opposite end. A bore extends through the carrier from the first end to the second end, forming a carrier wall between the bore and the exterior surface of the carrier. The bore is offset from a central axis of the carrier (the axis of the cylindrical outer surface of the carrier), creating an increased-thickness portion of the carrier wall on a first side of the carrier. A set of cavities are formed within the increased-thickness portion of the carrier wall (e.g., by drilling holes into the carrier wall). One or more sensors are then positioned within corresponding ones of the cavities, so that the carrier wall forms a housing for each of the sensors. The sensors may include, for example, a tubing sensing gauge, an annulus sensing gauge, or a remote tap sensing gauge.

The instrumented coupling may also include one or more electronics packages that are positioned in corresponding ones of the cavities in the carrier wall. These cavities may be which are sealed to prevent fluids from the sensor cavities and from the bore and the exterior of the carrier from reaching the electronics packages. The instrumented coupling may include electrical interconnects which electrically connect the sensors and the electronics packages to corresponding electrical terminals in a sealed compartment within the carrier wall.

The cavities within the carrier wall may be positioned at circumferentially displaced locations around the carrier, so that the elongated sensors are side-by-side within the carrier wall. The carrier may therefore be shorter than a conventional carrier, in which the components of each sensor assembly (e.g., sensor, electronics, manifold) are positioned end-to-end in a tubular housing. Since the carrier itself serves as the sensor housing, the material of the conventional sensor housing can be eliminated, and the overall amount of material which is required for the coupling (carrier and sensor packages) is reduced.

In some embodiments, one of the sensor cavities includes a port through which the interior of the cavity is in fluid communication with the exterior of the carrier (hence the annulus between the carrier and the well bore). One of the cavities may have a port through which the interior of this cavity is in fluid communication with the bore that extends through the carrier. Another one of the cavities may be configured to enable a feed-through electrical cable to be installed to pass through the carrier, or to extend from the exterior of the carrier into one or more of the cavities within the carrier wall, where it can be connected to the sensor.

One alternative embodiment may include a method for manufacturing instrumented downhole couplings as described above. Another alternative embodiment may comprise a carrier as described above which is configured to serve as a coupling and to provide an enclosure for sensors and associated electronics within the carrier wall. Numerous other embodiments are also possible.

Embodiments disclosed herein may provide a number of advantages over prior art systems and methods. For example, proposed approaches for assembling rotors and subsequently magnetizing the assembled rotors allow for safer rotor assembly and higher productivity with respect to the manufacture of the rotors, which reduces manufacturing costs associated with permanent magnet motors. The disclosed embodiments also enable the magnetization of assembled rotors in the field, including magnetizing rotors that have become demagnetized in the course of operation in the field.

BRIEF DESCRIPTION OF THE DRAWINGS

Other objects and advantages of the invention may become apparent upon reading the following detailed description and upon reference to the accompanying drawings.

Figure 1:
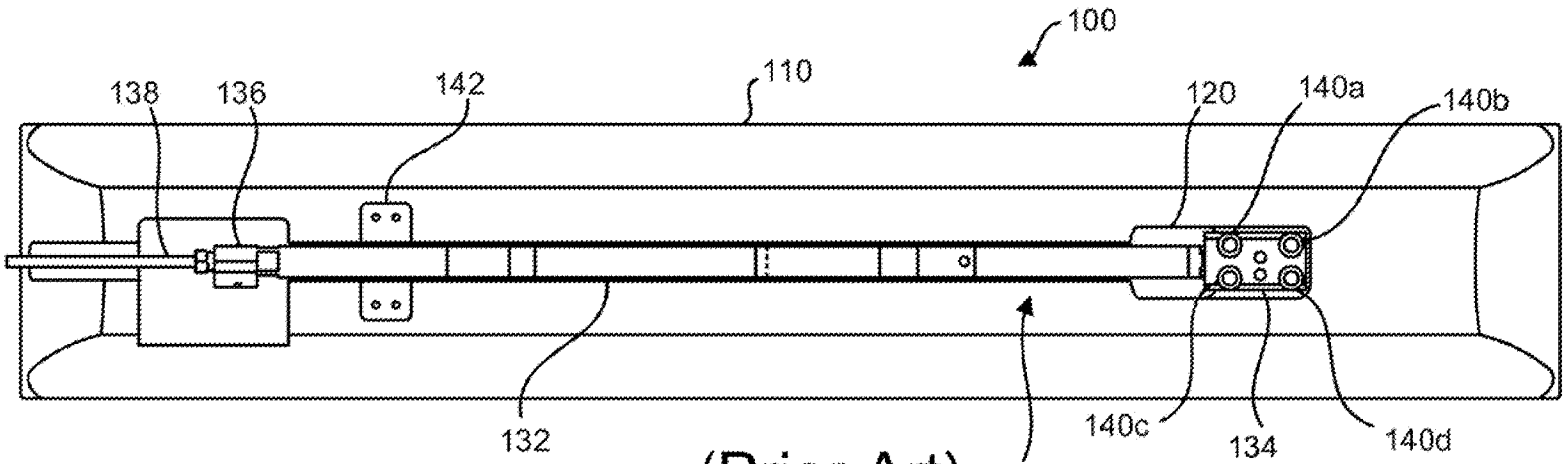
(Prior Art) FIG. 1
FIG. 1 is a diagram illustrating a conventional gauge package in accordance with the prior art.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as described herein. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

This disclosure is directed to an improved instrumented coupling or gauge package that uses a carrier which serves as a housing for sensors and associated electronics that are installed in pockets or cavities within the carrier wall. The carrier may have an offset bore, so that the carrier wall is thicker on one side, allowing larger cavities to be provided for the sensors and electronics.

Figure 2:
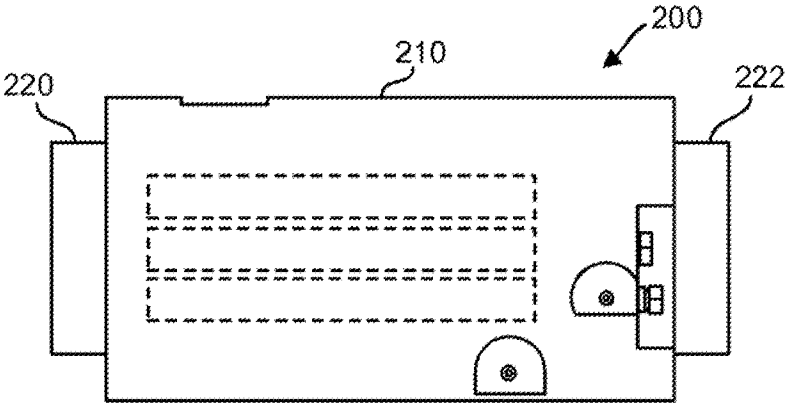
FIG. 2 is a diagram illustrating an improved gauge package in accordance with one embodiment.

Referring to FIGS. 1 and 2, diagrams illustrating differences between a conventional gauge package and an improved gauge package (an instrumented coupling) in accordance with one embodiment of the invention are shown. As depicted in FIG. 1, the conventional gauge package 100 is constructed using an elongated tubular mandrel 110 which serves as a carrier. A coupling is formed at each end of the mandrel so that the gauge package can be connected to a pipe section, tubing, or other downhole equipment. An elongated pocket 120 is milled into the exterior of the mandrel. Pocket 120 is sized to accommodate a sensor package 130 therein. The sensor package itself has a long tubular housing 132 that encloses the sensors and associated electronics of the sensor package. In this example, sensor package 130 has a manifold 134 at one end which is mounted over a port to the bore at the interior of mandrel 110 and allows fluid communication between the sensor inside the sensor package and the bore of the mandrel. A set of bolts 140*a*-140*d* secure manifold 134 to mandrel 110. The interface between manifold 134 and mandrel 110 is sealed to prevent fluids from the exterior of the mandrel from entering the sensor package. At the other end 136 of the sensor package is a coupling which allows a cable, TEC (tubing encapsulated conductor) or other conductor 138 to be electrically connected to the electronic components within sensor package 130. A bracket 142 is provided to secure this end of sensor package 130 to mandrel 110.

Referring to FIG. 2, improved gauge package 200 is depicted in a scale which is substantially the same as the conventional gauge package of FIG. 1 in order to illustrate the overall size of the improved gauge package with respect to the conventional design. In this embodiment, the carrier 210 is again a tubular structure having a coupling 220, 222 on each end which enables the carrier to be connected in line to a pipe section or other equipment. A bore extends through the carrier from one coupling to the other. Rather than providing a pocket on the exterior of the carrier, as in the conventional design of FIG. 1, this embodiment has elongated cavities formed within the wall of the carrier (e.g., at positions indicated by the dashed lines), and the sensors and corresponding electronic components are placed within these cavities. The carrier itself therefore serves as a housing for each of the sensors and corresponding electronics, so it is not necessary to manufacture a separate sensor package housing for each of the sensors and their corresponding electronics. Further, the cavities and the sensors/electronics are positioned side-by-side within the wall of the carrier, allowing the carrier to be substantially shorter than the conventional mandrel-type carrier, which holds the sensor packages as elongated, end-to-end configured assemblies.

Figure 3:
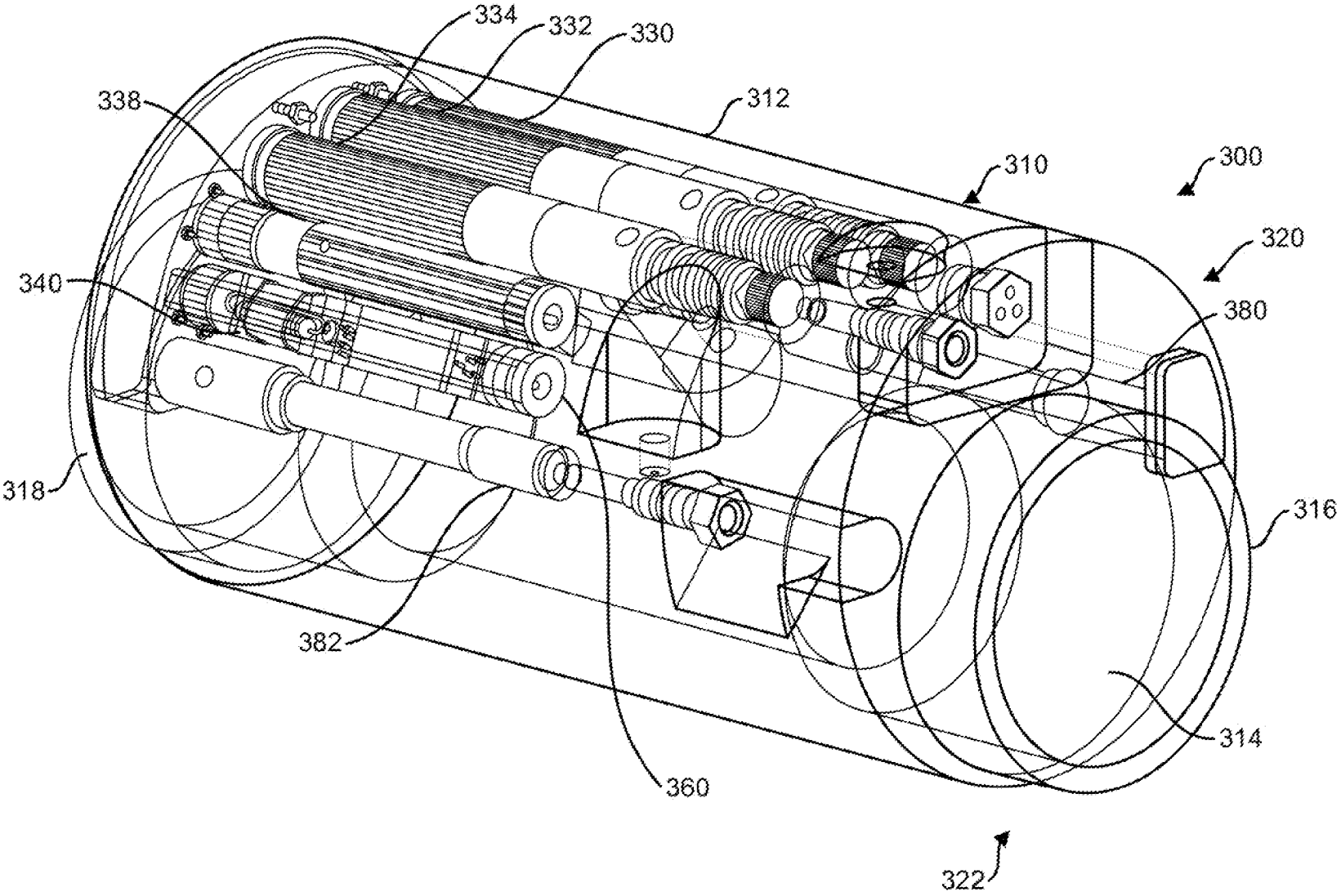
FIG. 3 is a diagram illustrating a perspective view of the components of an instrumented coupling in accordance with one embodiment.
Figure 4:
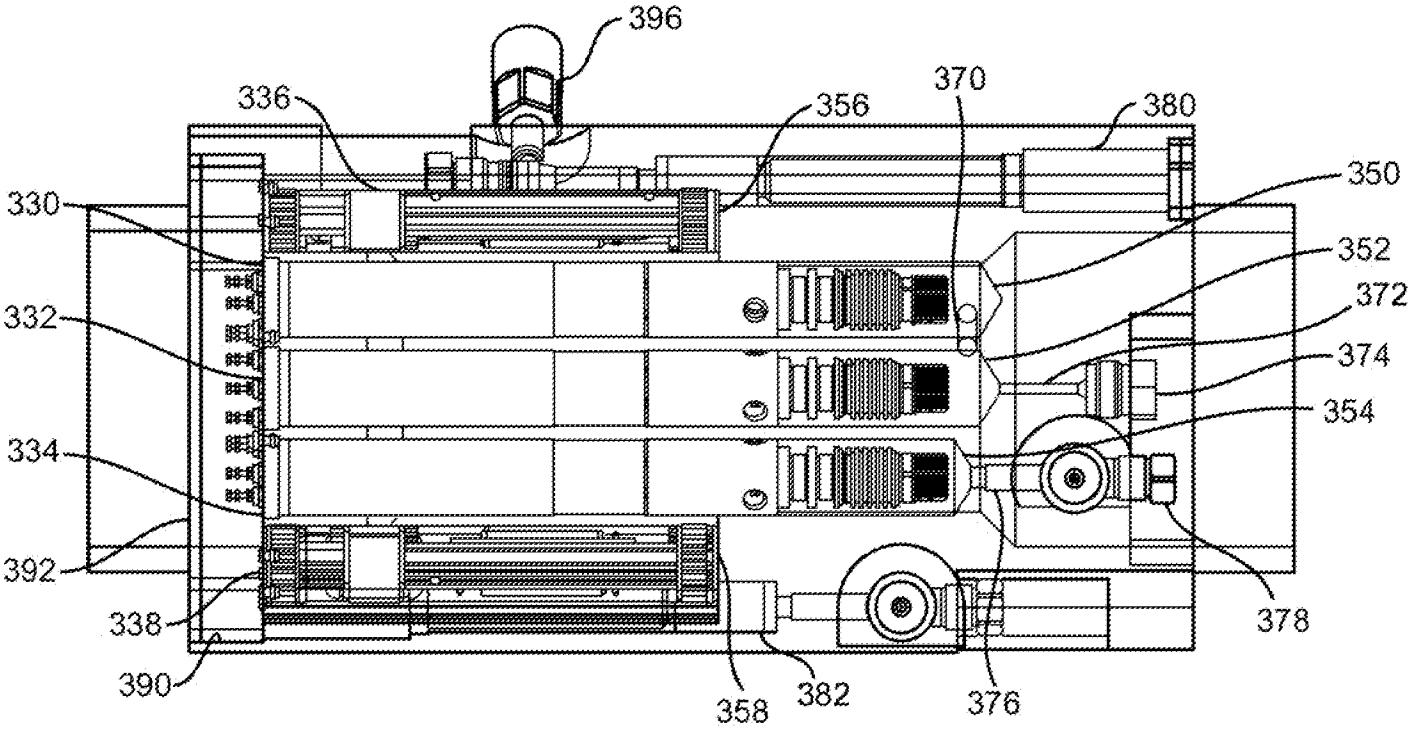
FIG. 4 is a diagram illustrating a plan view of the components of an instrumented coupling in accordance with one embodiment.

Referring to FIGS. 3 and 4, detailed diagrams illustrating the configuration of an instrumented coupling in accordance with an exemplary embodiment of the invention is shown. FIG. 3 shows a perspective view of the components of the instrumented coupling, while FIG. 4 shows a plan view of the components.

Referring to FIGS. 3 and 4, an exemplary instrumented coupling 300 has a set of sensors and associated electronics which are installed in a carrier 310. Carrier 310 has a generally cylindrical exterior surface 312 and has a generally cylindrical bore 314 therethrough. A coupling (316, 318) is provided at each end of bore 314 to enable the gauge package to be connected inline with other downhole equipment (e.g., pipe sections). Couplings 316 and 318 may, for example be internally threaded couplings that are configured to be connected to externally threaded adjacent components. In one embodiment, the carrier is a unitary component which is formed by machining the carrier out of a single, solid piece of metal.

Bore 314 is not coaxial with exterior surface 312, but is instead offset so that the wall of the carrier which is formed between the bore and the exterior surface has a first portion 320 on one side of the bore which is thicker than a second portion 322 on the opposite side of the bore. As depicted in FIG. 3, the axis of cylindrical bore 314 is below the axis of cylindrical exterior surface 312, so that the first, thicker portion 320 is at the top of the gauge package, and the second, thinner portion 322 is at the bottom of the gauge package.

Bore 314 is offset in order to provide sufficient thickness in first wall portion 320 to allow pockets to be milled into the thickened wall portion. These pockets accommodate one or more sensors and their associated electronics. In the example of FIGS. 3 and 4, three pockets are provided to accommodate sensors and three pockets are provided to accommodate three sets of electronics corresponding to the three sensors.

In this example, the pockets are drilled into the second wall portion 312 of the carrier. The sensors are conventionally installed in a tube that forms a housing for the gauge package, but in this embodiment, the sensors are instead inserted into the pockets that are drilled into the thickened wall of the carrier. Thus, the carrier serves as the housing for each of the sensors, eliminating the need to provide the tubular housing that would be secured to the exterior of the carrier in a conventional design. This eliminates the need for the material and cost associated with manufacturing the separate housing for the "housingless" sensors and reduces the cost of the gauge package with respect to conventional designs. The electronics associated with each of the sensors are likewise installed in pockets drilled into the wall of carrier 310, so that the carrier serves as the housing for the electronics.

In the example of FIGS. 3 and 4, sensor 330 is installed in pocket 350, sensor 332 is installed in pocket 352, and sensor 334 is installed in pocket 354. Likewise, electronics 336 are installed in pocket 356, electronics 338 are installed in pocket 358, and electronics 340 are installed in pocket 360. It is common for gauge packages to use from one to three sensors (was associated with electronics) in a gauge package. A pair of cable feedthroughs 380 and 382 may also be provided in carrier 310 two allow cables or other conductors to be installed to pass through the carrier. In some embodiments, a carrier such as is depicted in FIGS. 3 and 4 is manufactured as a standardized design into which one, two, or three sensors and their associated electronics can be installed. This use of a standardized carrier design can provide manufacturing efficiencies that are not found in conventional approaches in which a pocket is custom-milled into a mandrel to accommodate a specific number of sensor packages.

FIGS. 3 and 4 provide an example of a gauge package in which all three sensors are installed, but if fewer sensors are needed, the desired sensors can be installed in corresponding pockets of an identical carrier while one or more of the pockets may simply be left empty. For instance, in one alternative embodiment, sensor 330 and corresponding electronics (e.g., 336) may be installed in corresponding pockets 350 and 356, while pockets 352, 354, 358 and 360 are left empty. The specific drilled pockets into which the sensor(s) is/are installed may depend upon the purpose of the sensor.

For example, a sensor for monitoring conditions within the bore of the carrier would be installed in one of the pockets that is in fluid communication with the bore, while a sensor for monitoring conditions in the annulus of the well would be installed in one of the pockets that is include communication with the exterior of the carrier. In the embodiment of FIGS. 3 and 4, a small conduit 370 connects pocket 350 to the bore 314 of carrier 310 to enable fluid communication between the pocket and the bore. Another small conduit 372 provides a port from pocket 352 two the exterior of carrier 310 so that the pocket can be in fluid communication with the annulus at the exterior of the carrier. A valve 374 may be provided to selectively enable fluid communication between pocket 352 and the annulus at the exterior of the carrier. A conduit 376 may be provided between pocket 354 and a connector 378 to enable fluid communication between the pocket and an external conduit that can be coupled to connector 378 for remote tap sensing or other purposes.

A pressure test adapter 396 is shown in FIG. 4 connected to a pressure test port of the instrumented coupling. The pressure test adapter is not part of the instrumented coupling, but is a piece of existing test equipment that is included in the figure to show that the instrumented coupling is adapted to allow such existing test equipment to be connected to it for the purpose of pressure testing the instrumented coupling. Additional pressure test port 397 is also provided at conduit 376 to allow pressure testing of pocket 354, and pressure test port 398 is provided to allow pressure testing of feedthrough 382. As indicated above, the instrumented coupling is also adapted to use existing sensor and electronics components, albeit without the conventional sensor package housing that is secured to the exterior of conventional carriers.

Figure 5A:
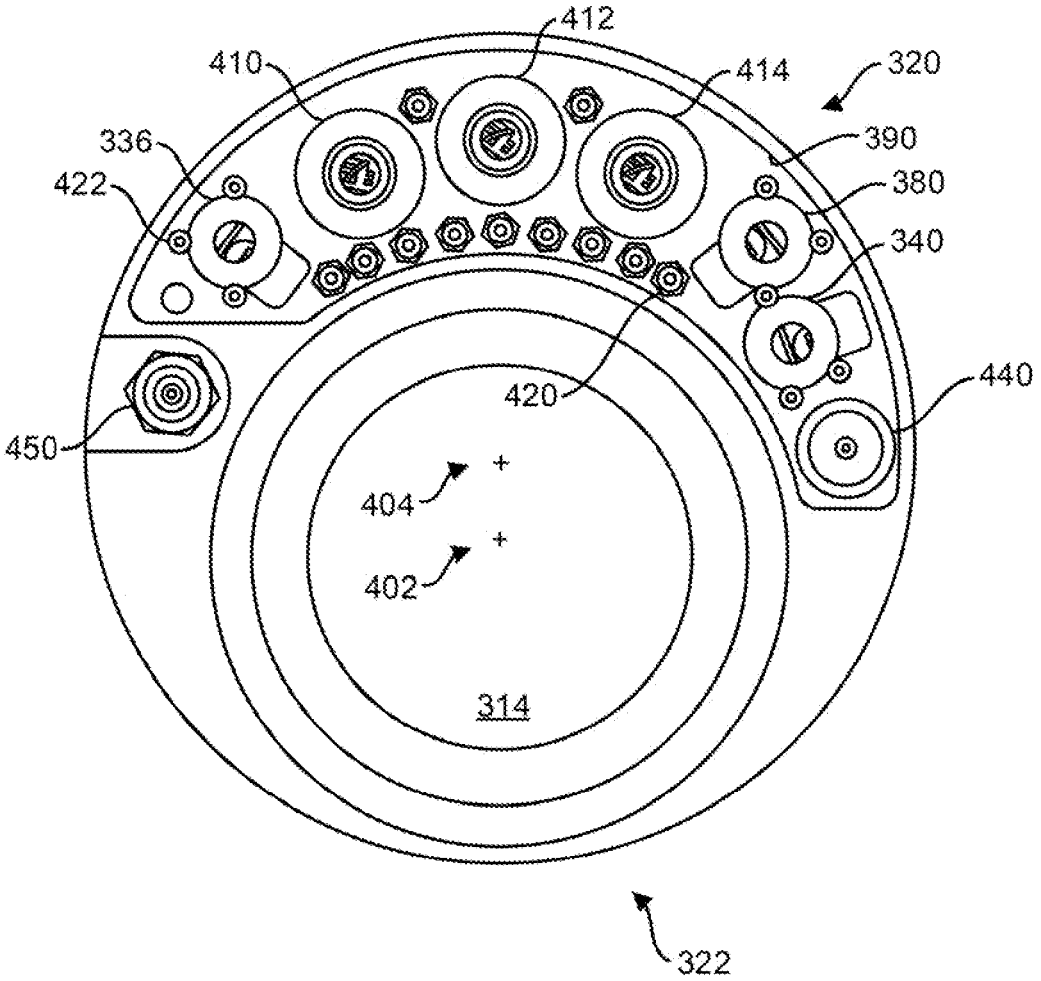
FIGS. 5A and 5B are diagrams illustrating a first end of an instrumented coupling in accordance with one embodiment.
Figure 5B:
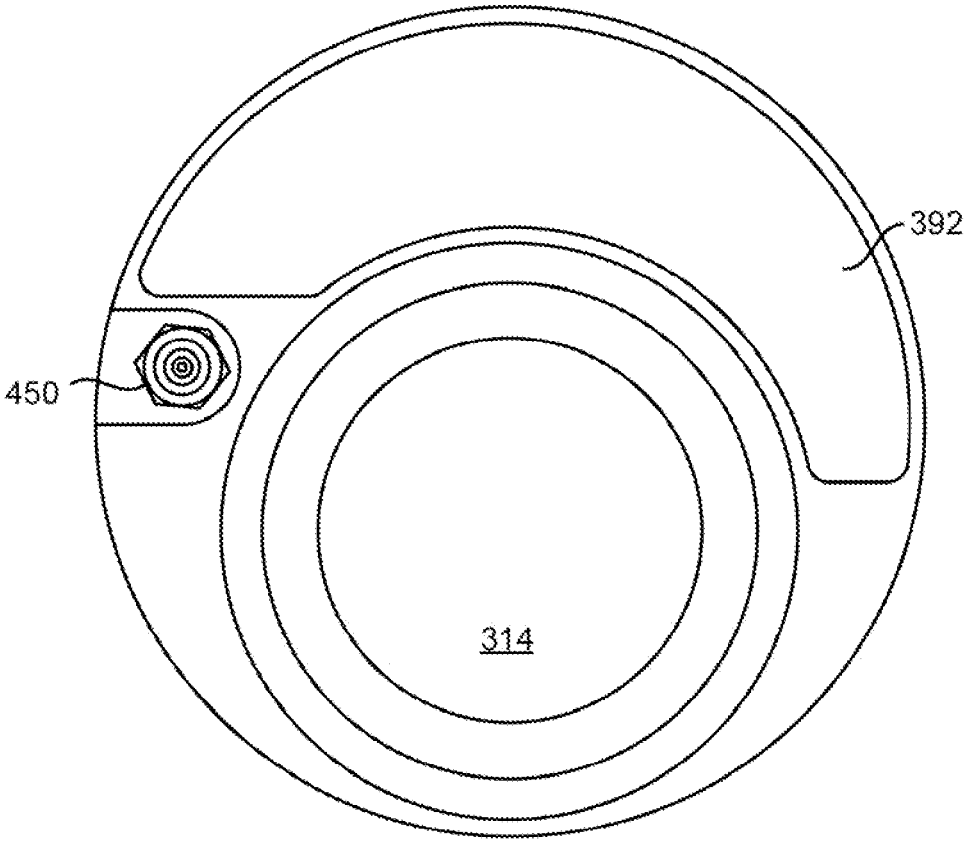
Figure 6:
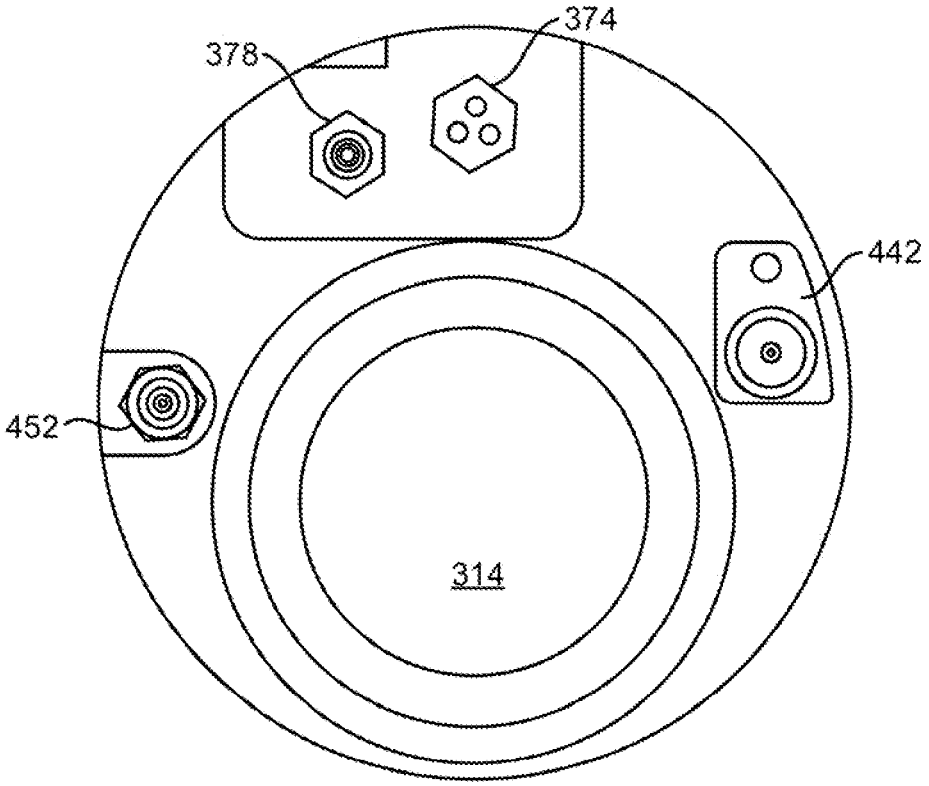
FIG. 6 is a diagram illustrating a second end of an instrumented coupling in accordance with one embodiment.

Referring to FIGS. 5A, 5B and 6, a set of diagrams showing end views of the exemplary instrumented coupling are shown. FIGS. 5A and 5B depict a first end of the instrumented coupling (corresponding to the left end of the instrumented coupling in FIGS. 3 and 4). FIG. 5A shows the end of the gauge package prior to installation of a compartment cover, while FIG. 5B shows the same end of the gauge package after the compartment cover has been installed. FIG. 6 shows the opposite end of the gauge package (corresponding to the right end of the gauge package in FIGS. 3 and 4).

Referring to FIG. 5A, the positioning of the bore 314 with respect to the exterior of the carrier 310 is shown. In this figure, it can be more clearly seen that the axis 402 of bore 314 is offset (downward in the figure) from the axis 404 of the cylindrical carrier body. It can also be more clearly seen in this figure that the offset of the bore causes the wall of the carrier to be thinner at the bottom of the figure and thicker at the top of the figure. The thickened upper portion 320 is wide enough that the pockets for the sensors and electronics can be drilled into the carrier wall. This figure also shows that the pockets are angularly displaced from each other around the circumference of the carrier (as determined from either the axis 404 of the carrier or the axis 402 of the bore) so that the sensors and the associated electronics are positioned side-by-side (FIG. 4 shows that the sensors and associated electronics are positioned at substantially the same axial position, where "axial" is left-to-right in the figure).

Each of the pockets that are drilled into carrier 310 opens to a compartment 390 at the end of the carrier. The sensors and associated electronics are inserted into the pockets from the openings at compartment 390. In this embodiment, the sensors are enclosed in their respective pockets by welding caps (410, 412, 414) onto the ends of the respective pockets. Electrical conductors from each of the sensors extend through the caps, and these conductors may be secured to terminals or "turrets" (e.g., 420) within compartment 390. Electronics (336, 338, 340) for the sensors are inserted into the respective ones of the pockets and are secured by screws (e.g., 422) conductors from the electronics extend into compartment 390, where they can be secured to the appropriate ones of terminals 420, thereby electrically connecting the electronics to the corresponding sensors. Conductors from a cable in feedthrough 382 may be electrically connected to appropriate ones of the sensors/electronics or, if the feedthrough is not used, a cover 440 may be welded onto the opening of the feedthrough into compartment 390.

Referring to FIG. 5B, After the sensors and associated electronics have been installed in the pockets of the carrier and appropriate electrical connections have been made, a cover 392 is positioned at the end of the carrier to enclose compartment 390. In this embodiment, cover 392 is welded to the carrier to seal compartment 390. Feedthrough connector 450 for feedthrough 380 remains accessible at this end of the carrier after cover 392 has been welded in place over compartment 390. While cover 440 and cover 392 obstruct the end of feedthrough 382, the connector 452 for this feedthrough remains accessible at the opposite end of the carrier as shown in FIG. 6. It can also be seen in FIG. 6 that a front plate 442 can be welded over the end of feedthrough 380. FIG. 6 also shows that valve 374, which is allows fluid to flow through conduit 372, and connector 378, which allows an external conduit to be coupled to cavity 354, are accessible at the end of the carrier.

Figure 7A:
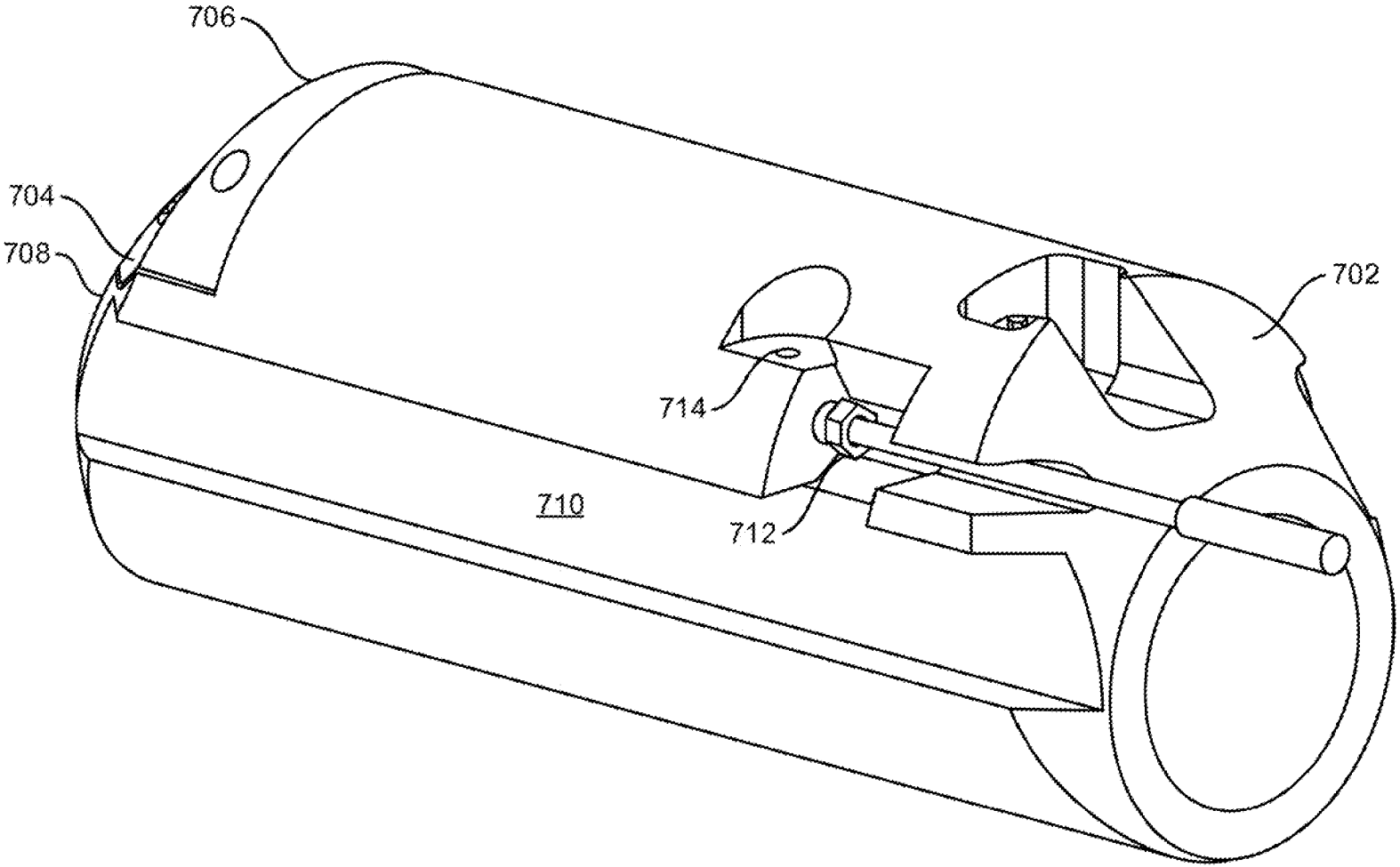
FIGS. 7A and 7B are diagrams illustrating an instrumented coupling in accordance with an alternative embodiment.
Figure 7B:
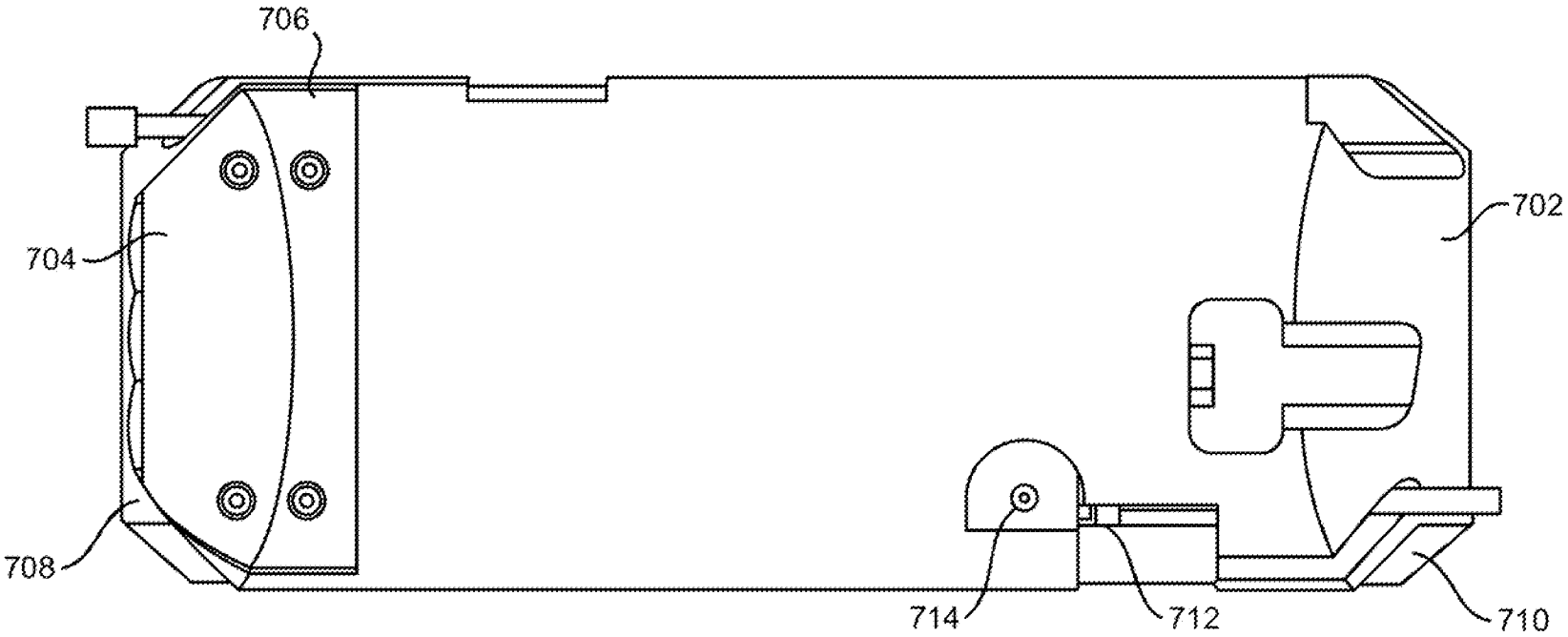

Referring to FIGS. 7A and 7B, an alternative embodiment of an instrumented coupling is shown. In this embodiment, the configuration of the pockets and other features interior to instrumented coupling 700 is substantially the same as described in connection with FIGS. 3 and 4. The exterior configuration is somewhat different.

In the embodiment of FIGS. 7A and 7B, the exterior surface at each end of the instrumented coupling is chamfered, rather than being stepped down from the smaller diameter at the ends of the apparatus to the larger diameter along the body of the carrier. At one end (on the right side of FIGS. 7A and 7B), the carrier is chamfered 702. At the other end, the chamfer 704 extends across a cover 706, as well as a part 708 of the end of the carrier. Instrumented coupling 700, like the apparatus of FIGS. 3 and 4, has a compartment at the ends of the internal pockets, where the compartment has a cover is welded to the carrier. Cover 706 is secured over the welded cover and serves as a bumper as well as providing chamfered surface 704.

Another feature of instrumented coupling 700 is a bypass cutout 710. Cables, TECs or the like which are connected to equipment above the instrumented coupling may extend through bypass cutout 710 to equipment below the instrumented coupling, bypassing any connection to the instrumented coupling itself. Instrumented coupling 700 also includes external features common to instrumented coupling 300, such as a feedthrough connector 712 and pressure test ports (e.g., 714)

Embodiments of the present invention may provide a number of advantages over existing designs. For example, as noted above, the present embodiments may be substantially shorter than conventional designs (e.g., an embodiment equivalent to a 40-inch long conventional carrier may be on the order of 12 inches long), reducing the amount of material that is required for the carrier and reducing the corresponding material cost.as also noted above, the use of the carrier wall itself as the housing for each of the sensor packages eliminates the need to provide separate sensor housings and consequently reduces the amount of material required for the apparatus, as well as the cost. Although the separate sensor housings are eliminated, the present embodiments can nevertheless use existing sensor and electronics components, and can achieve the same sensor configurations as the conventional designs. The present embodiments also reduce the amount of welding that is required to construct the instrumented coupling (the welding associated with the sensor package housings is eliminated), so there is less leak path than in conventional designs. By housing the sensors and associated electronics within the carrier wall, the present embodiments eliminate the need for manifold sealing kits that are necessary in conventional designs to seal the sensor package manifold against the carrier. The eliminated components and reduced materials may reduce the cost of the instrumented coupling by thousands of dollars.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the description herein.

What is claimed is:

1. An instrumented downhole coupling comprising:

a tubular carrier having a first coupling at a first end of the carrier and a second coupling on a second end of the carrier opposite the first end;

a bore extending through the carrier from the first end to the second end, thereby forming a carrier wall between the bore and an exterior surface of the carrier, wherein the bore is offset from a central axis of the carrier, thereby creating an increased-thickness portion of the carrier wall on a first side of the carrier;

one or more separate sensor cavities formed within the increased-thickness portion of the carrier wall, wherein the carrier wall forms walls of the sensor cavities, wherein each of the sensor one or more cavities is sealed, except that at least a first sensor cavity of the one or more sensor cavities has a port connecting the first sensor cavity to the bore and at least a second cavity of the one or more sensor cavities has a port connecting the second sensor cavity to an exterior of the carrier;

one or more sensors positioned within corresponding ones of the one or more sensor cavities, the carrier wall forming a housing for each of the one or more sensors; and one or more sealed electronics cavities housing one or more electronics packages which are coupled to the one or more sensors, wherein the one or more sealed electronics cavities prevent fluids from the bore and the exterior of the carrier from entering the one or more electronics cavities.

2. The instrumented downhole coupling of claim 1, wherein the one or more cavities are positioned at circumferentially displaced locations within the carrier wall.

3. The instrumented downhole coupling of claim 1, further comprising:

a first port in a first one of the one or more cavities, wherein the first port enables fluid communication between the first one of the one or more cavities and an exterior of the carrier;

a second port in a second one of the one or more cavities, wherein the second port enables fluid communication between the second one of the one or more cavities and the bore through the carrier; and at least one feed-through cavity in the carrier wall configured to enable a feed-through electrical cable to be installed to pass through the carrier.

4. The instrumented downhole coupling of claim 1, further comprising a plurality of electrical interconnects which electrically connect the one or more sensors and the one or more electronics packages to corresponding electrical terminals in a sealed one of the one or more cavities, wherein each of the terminals corresponding to the one or more sensors is electrically connected to one of the terminals of one of the one or more electronics packages, thereby electrically connecting each of the one or more sensors to a corresponding one of the one or more electronics packages, wherein the terminals are contained in a sealed compartment within the carrier wall.

5. The instrumented downhole coupling of claim 1, at least one feed-through cavity in the carrier wall configured to enable a feed-through electrical cable to be installed to pass through the carrier.

6. The instrumented downhole coupling of claim 1, wherein the one or more sensors include at least one of: a tubing sensing gauge; an annulus sensing gauge; and a remote tap sensing gauge.

7. A method for manufacturing an instrumented downhole coupling, the method comprising:

forming a tubular carrier having a first coupling at a first end of the carrier and a second coupling on a second end of the carrier opposite the first end;

forming a bore which extends through the carrier from the first end to the second end, thereby forming a carrier wall between the bore and an exterior surface of the carrier, wherein the bore is offset from a central axis of the carrier, thereby creating an increased-thickness portion of the carrier wall on a first side of the carrier;

forming one or more separate sensor cavities within the increased-thickness portion of the carrier wall, wherein the carrier wall forms walls of the sensor cavities, wherein each of the sensor one or more cavities is sealed, except that at least a first sensor cavity of the one or more sensor cavities has a port connecting the first sensor cavity to the bore and at least a second cavity of the one or more sensor cavities has a port connecting the second sensor cavity to an exterior of the carrier; and positioning one or more sensors within corresponding ones of the one or more sensor cavities, the carrier wall forming a housing for each of the one or more sensors.

8. The method of claim 7, further comprising positioning the one or more cavities at circumferentially displaced locations within the carrier wall.

9. The method of claim 7, further comprising forming a port in at least one of the one or more cavities through which an interior of the at least one cavity is in fluid communication with an exterior of the carrier.

10. The method of claim 7, further comprising forming a port in at least one of the one or more cavities through which an interior of the at least one cavity is in fluid communication with the bore through the carrier.

11. The method of claim 7, further comprising positioning one or more electronics packages in corresponding ones of the one or more of the cavities and sealing the electronics packages in the corresponding cavities, thereby preventing fluids from the bore and the exterior of the carrier from entering the ones of the one or more of the cavities in which the one or more electronics packages are positioned.

12. The method of claim 11, further comprising electrically connecting the one or more sensors and the one or more electronics packages to corresponding electrical terminals in a sealed one of the one or more cavities via a plurality of electrical interconnects; connecting each of the terminals corresponding to the one or more sensors to one of the terminals of one of the one or more electronics packages, thereby electrically connecting each of the one or more sensors to a corresponding one of the one or more electronics packages; and sealing the terminals in a compartment within the carrier wall.

13. The method of claim 7, further comprising forming at least one feed-through cavity in the carrier wall, wherein the feed-through cavity is configured to enable a feed-through electrical cable to be installed to pass through the carrier.

14. The method of claim 7, wherein the one or more sensors include at least one of: a tubing sensing gauge; an annulus sensing gauge; and a remote tap sensing gauge.

15. The method of claim 7, wherein forming the one or more sensor cavities comprises drilling the one or more sensor cavities into the increased-thickness portion of the carrier wall, and wherein positioning the one or more sensors into the corresponding ones of the one or more sensor cavities comprises inserting each of the one or more sensors into an open drilled end of the corresponding one of the one or more sensor cavities.

16. The method of claim 15, further comprising sealing the open drilled ends of the one or more sensor cavities after the corresponding ones of the one or more sensors have been inserted into the drilled sensor cavities.

17. A carrier for an instrumented downhole coupling comprising:

a tubular carrier body having a first coupling at a first end of the carrier and a second coupling on a second end of the carrier opposite the first end;

a bore extending through the carrier from the first end to the second end, thereby forming a carrier wall between the bore and an exterior surface of the carrier, wherein the bore is offset from a central axis of the carrier, thereby creating an increased-thickness portion of the carrier wall on a first side of the carrier;

one or more separate sensor cavities formed within the increased-thickness portion of the carrier wall, the carrier wall around each of the one or more cavities forming a sensor housing adapted to accept one or more sensors and associated electronics therein;

wherein at least a first one of the one or more cavities includes a port through which an interior of the first one of the one or more cavities is in fluid communication with an exterior of the carrier, and wherein at least a second one of the one or more cavities includes a port through which an interior of the second one of the one or more cavities is in fluid communication with the bore through the carrier.

18. The carrier of claim 17, wherein the one or more cavities which are positioned at circumferentially displaced locations within the carrier wall.

* * * * *